US009303916B2

(12) United States Patent
Ozyuksel et al.

(10) Patent No.: US 9,303,916 B2
(45) Date of Patent: Apr. 5, 2016

(54) BUILT-IN HOUSEHOLD APPLIANCE COMPRISING A DECORATIVE PANEL

(71) Applicant: ARCELIK ANONIM SIRKETI, Istanbul (TR)

(72) Inventors: Faik Emre Ozyuksel, Istanbul (TR); Osman Vardar, Istanbul (TR); Birol Konak, Istanbul (TR); Umud Yazgan, Istanbul (TR)

(73) Assignee: Arcelik A.S., Istanbul (TR)

( * ) Notice: Subject to any disclaimer, the term of this patent is extended or adjusted under 35 U.S.C. 154(b) by 0 days.

(21) Appl. No.: 14/406,133

(22) PCT Filed: May 23, 2013

(86) PCT No.: PCT/EP2013/060595

§ 371 (c)(1),
(2) Date: Dec. 5, 2014

(87) PCT Pub. No.: WO2013/182428

PCT Pub. Date: Dec. 12, 2013

(65) Prior Publication Data

US 2015/0184928 A1 Jul. 2, 2015

(30) Foreign Application Priority Data

Jun. 5, 2012 (TR) ..... 2012/06553

(51) Int. Cl.
*F25D 25/02* (2006.01)
*F25D 23/02* (2006.01)
(Continued)

(52) U.S. Cl.
CPC ..... *F25D 23/028* (2013.01); *A47B 81/00* (2013.01); *A47B 95/00* (2013.01); *A47B 96/20* (2013.01);
(Continued)

(58) Field of Classification Search
CPC . F25D 23/025; F25D 23/028; F25D 2323/02; A47L 15/4261; A47B 96/20; A47B 95/00; A47B 2096/208
See application file for complete search history.

(56) References Cited

U.S. PATENT DOCUMENTS 4,514,021 A * 4/1985 Sundermeier et al. ..... 312/291
5,471,709 A * 12/1995 Lanzani ..... 16/238
(Continued)

FOREIGN PATENT DOCUMENTS

DE 3218837 A1 11/1983
EP 0647821 A1 4/1995
(Continued)

OTHER PUBLICATIONS

International search report.
(Continued)

*Primary Examiner* — Daniel Rohrhoff
(74) *Attorney, Agent, or Firm* — Venjuris P.C.

(57) ABSTRACT

The present invention relates to a built-in household appliance (1) comprising a body (2) placed into the furniture, a door (3) providing access into the body (2), a decorative panel (4) mounted on the outer surface of the door (3), at least two adjustment mechanisms (6, 106) fixed on the door (3), providing the decorative panel (4) to be moved with respect to the door (3) by being rotated around its axis and having two positioning screws (5, 105) for the two mutually perpendicular directions, and wherein one of the adjustment mechanisms (6, 106) has a third positioning screw (205), of which the rotational axis extends in the direction the decorative panel (4) is moved.

20 Claims, 5 Drawing Sheets

Figure 1:
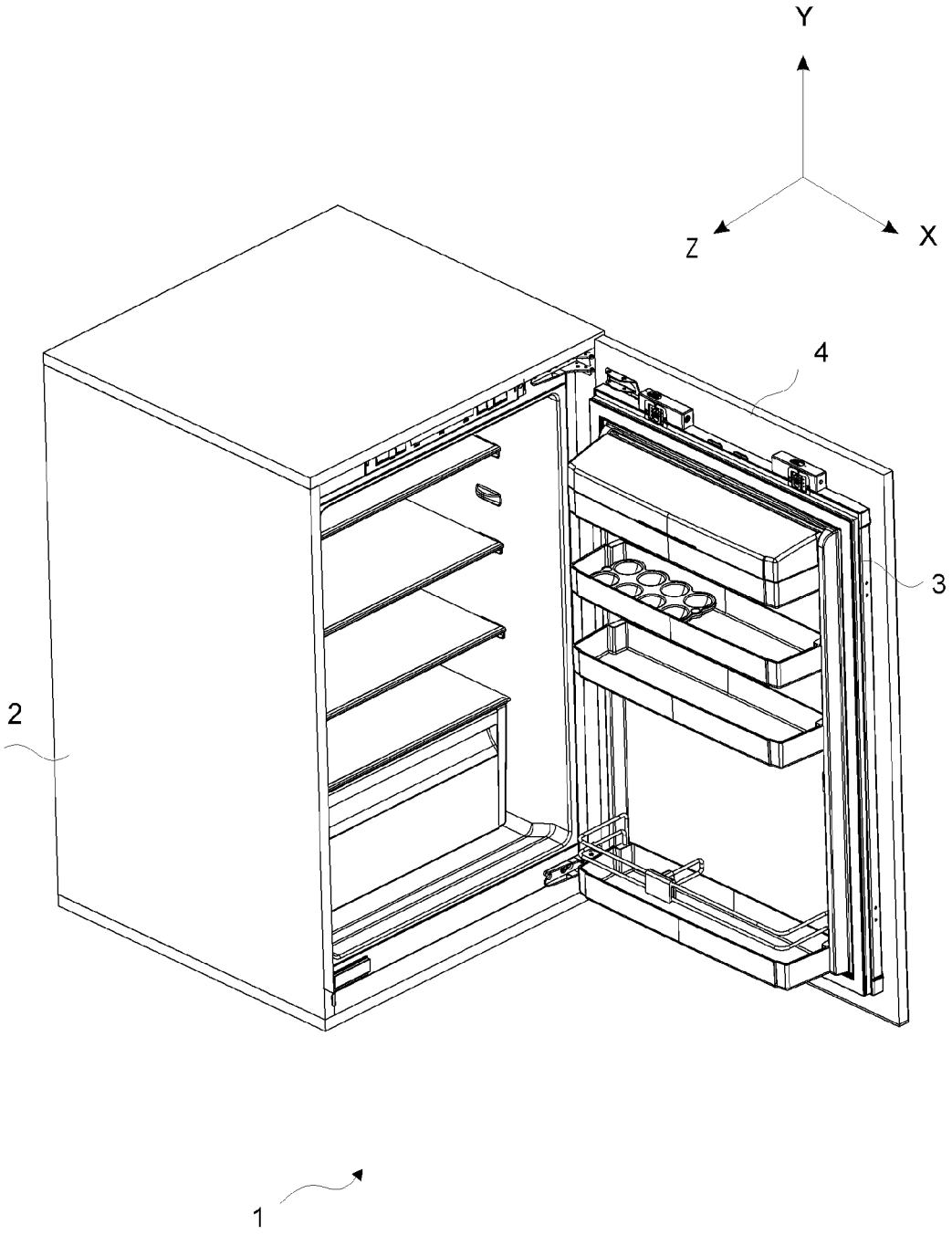

(51) Int. Cl.

| | |
|---|---|
| ***F25D 23/10*** | (2006.01) |
| ***A47B 81/00*** | (2006.01) |
| ***A47B 95/00*** | (2006.01) |
| ***A47L 15/42*** | (2006.01) |
| *A47B 96/20* | (2006.01) |

(52) U.S. Cl.
CPC ..... *A47L 15/4251* (2013.01); *A47L 15/4265* (2013.01); *F25D 23/10* (2013.01); *A47B 2096/208* (2013.01)

(56) References Cited

U.S. PATENT DOCUMENTS

| | | | | |
|---|---|---|---|---|
| 6,079,164 | A | 6/2000 | Lanzani | |
| 6,536,856 | B2 * | 3/2003 | Pelizzari et al. | 312/204 |
| 8,388,074 | B1 * | 3/2013 | Donberger et al. | 312/204 |
| 8,651,590 | B2 * | 2/2014 | Wilson et al. | 312/204 |
| 2004/0222725 | A1 * | 11/2004 | Park et al. | 312/405 |
| 2007/0113377 | A1 * | 5/2007 | Brachert | 16/247 |
| 2007/0188059 | A1 * | 8/2007 | Davis et al. | 312/265.6 |
| 2009/0045705 | A1 * | 2/2009 | Laible et al. | 312/204 |
| 2009/0045712 | A1 * | 2/2009 | Laible | 312/401 |
| 2009/0302723 | A1 * | 12/2009 | Laible et al. | 312/237 |
| 2011/0025173 | A1 | 2/2011 | Ciyanoglu | |
| 2011/0030188 | A1 * | 2/2011 | Ciyanoglu et al. | 29/426.2 |

FOREIGN PATENT DOCUMENTS

| | | |
|---|---|---|
| EP | 0718459 A2 | 6/1996 |
| FR | 2802787 A3 | 6/2001 |

OTHER PUBLICATIONS

Written Opinion of the International Search Authority.

* cited by examiner

BUILT-IN HOUSEHOLD APPLIANCE COMPRISING A DECORATIVE PANEL

The present invention relates to a built-in household appliance comprising a decorative panel mounted on the door.

In built-in household appliances, a decorative panel is mounted on the outer surface of the door and the door is opened by being rotated around the horizontal or the vertical axis while the panel is mounted thereon. The decorative panels, used for concealing the household appliance embedded into the furniture, disrupt the general appearance of the furniture group when the position is not properly adjusted. In the state of the art, built-in household appliances, having the adjustment mechanisms which enable precise adjustment of the decorative panel after being mounted on the door, are available. However, the utilization of the present adjustment mechanisms is difficult thereby causing the maintenance personnel to stay for a long period of time, resulting in loss of labor.

In the state of the art French Patent Document No. FR2802787, it is explained that the decorative panel mounted on the door of a built-in refrigerator is adjusted by means of an adjustment mechanism.

The aim of the present invention is the realization of a built-in household appliance wherein the position of the decorative panel mounted on its door is adjusted precisely and easily with respect to the door.

The built-in household appliance realized in order to attain the aim of the present invention, explicated in the first claim and the respective claims thereof, comprises a body placed into the furniture, a door providing access into the body, a decorative panel placed on the door and two adjustment mechanisms that move the decorative panel independently from the door in two directions perpendicular to each other by means of two mutually perpendicular positioning screws.

In the built-in household appliance of the present invention, one of the adjustment mechanisms comprises a third positioning screw, the rotational axis of which is in the same direction as the axis where the decorative panel is moved. Thus, which direction the positioning screws move the decorative panel is understood clearly.

In an embodiment of the present invention, while the first positioning screw provides the decorative panel to move close to or away from the door, the second positioning screw positions the decorative panel such that the inclination problems originating from the floor or the furniture are compensated. The third positioning screw moves the decorative panel in the horizontal direction.

In an embodiment of the present invention, the adjustment mechanisms are mounted on the upper edge of the door by means of a housing having a container wherein it can move.

In an embodiment of the present invention, the assembly of the door and the decorative panel is performed by means of a rail-shaped guide that is fixed to the decorative panel. In this embodiment, the built-in household appliance comprises a connector that transmits the motion received from the adjustment mechanisms to the guide, hence to the decorative panel. The decorative panel can be moved easily by means of the connector.

In a derivative of this embodiment, the distance of the decorative panel to the door is adjusted by means of a first shaft.

In an embodiment of the present invention, the movement of the decorative panel in the vertical plane is realized by means of a first transmitter which is actuated by the movement of the second positioning screw.

In an embodiment of the present invention, the movement of the decorative panel in the horizontal plane is realized by means of a second transmitter which is actuated by the movement of the third positioning screw.

In a derivative of this embodiment, the second transmitter comprises a recess enabling the first transmitter to move therein. By means of the recess, the first transmitter can move without budging the second transmitter.

In an embodiment of the present invention, the built-in household appliance comprises the first transmitter wherein the first positioning screw is disposed, the second transmitter wherein the first transmitter is disposed and the container wherein the second transmitter is disposed. Movement can be transmitted to the connector in three axes by means of the first shaft. The first positioning screw being located at the innermost position provides the movements of the first transmitter and the second transmitter to be also transferred to the connector.

In a derivative of this embodiment, a stopper is situated on the container that limits the movement of the decorative panel in the horizontal direction. The stopper is a cavity that is opened on the container in the vertical direction. The movement capability of the second transmitter is as far as the borders of the cavity.

By means of the present invention, the maintenance personnel knows the axes where the positioning screws act on the decorative panel and thereby can mount the decorative panel to be suitable to the general appearance of the furniture in a short period of time. This situation increases customer satisfaction.

The model embodiments relating to a built-in household appliance realized in order to attain the aim of the present invention are illustrated in the attached figures, where:

FIG. 1—is the perspective view of a built-in household appliance in an embodiment of the present invention.

Figure 2:
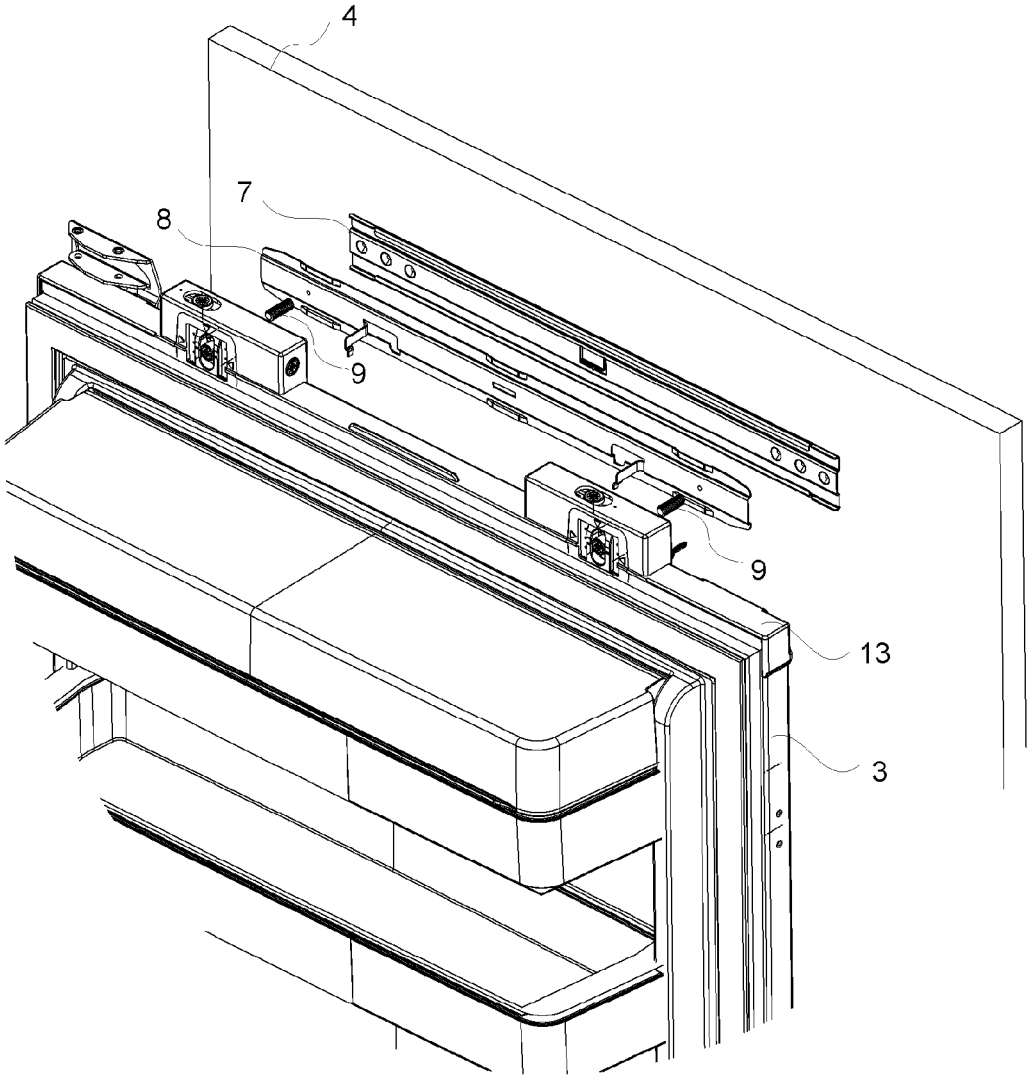

FIG. 2—is the exploded view of the decorative panel, the guide, the connector and the door in an embodiment of the present invention.

Figure 3:
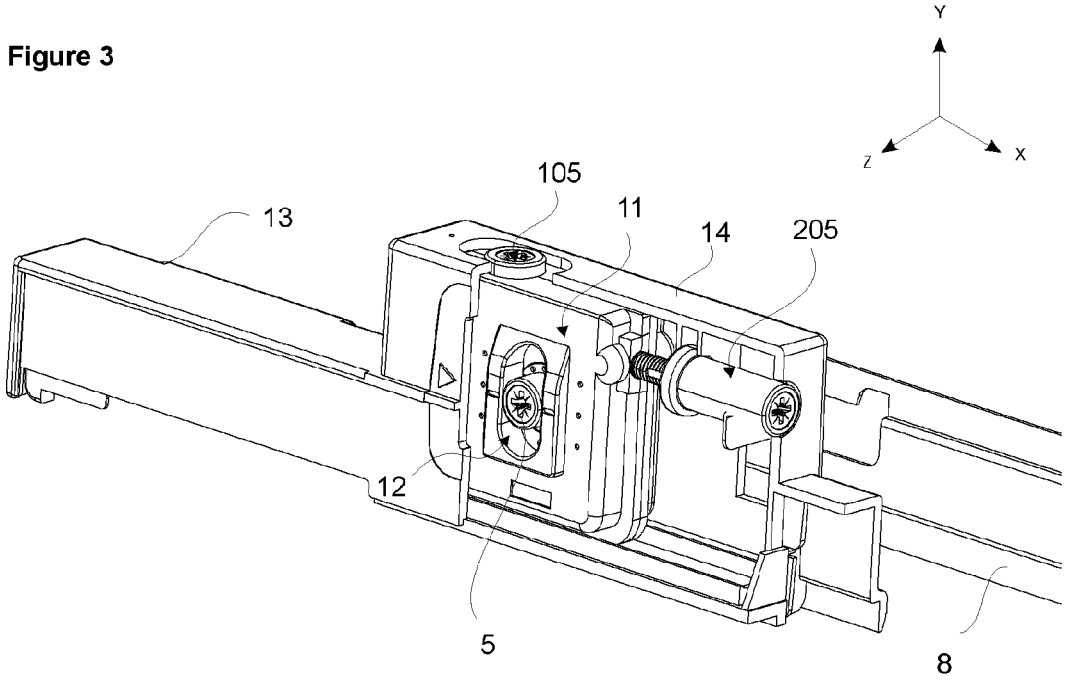

FIG. 3—is the partial perspective view of the adjustment mechanism, the connector and the container in an embodiment of the present invention.

Figure 4:
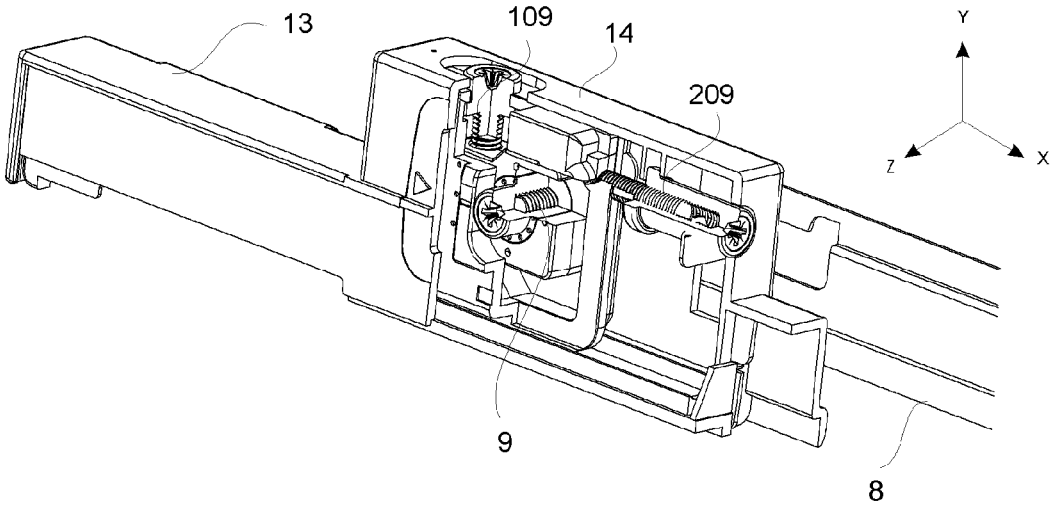

FIG. 4—is the partial cross-sectional view of the adjustment mechanism, the connector and the container in an embodiment of the present invention.

Figure 5:
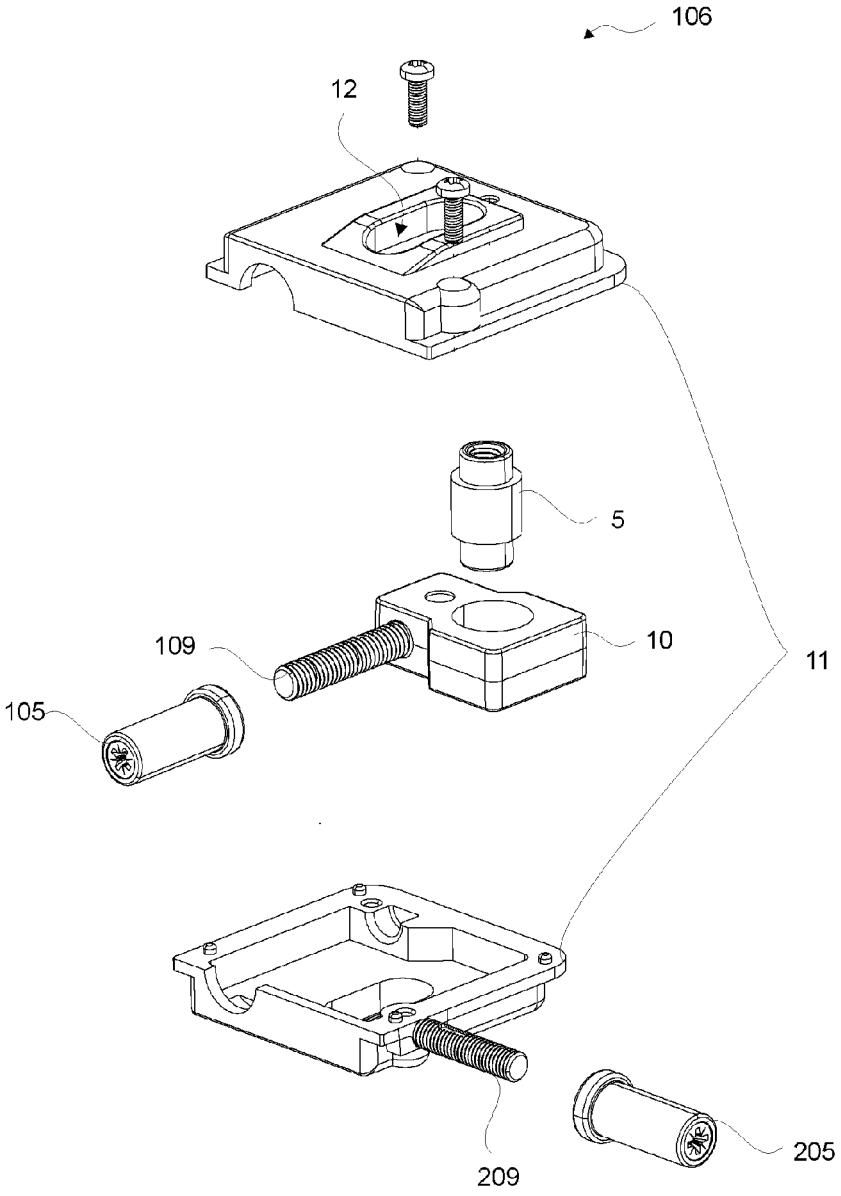

FIG. 5—is the exploded view of the adjustment mechanism in an embodiment of the present invention.

Figure 6:
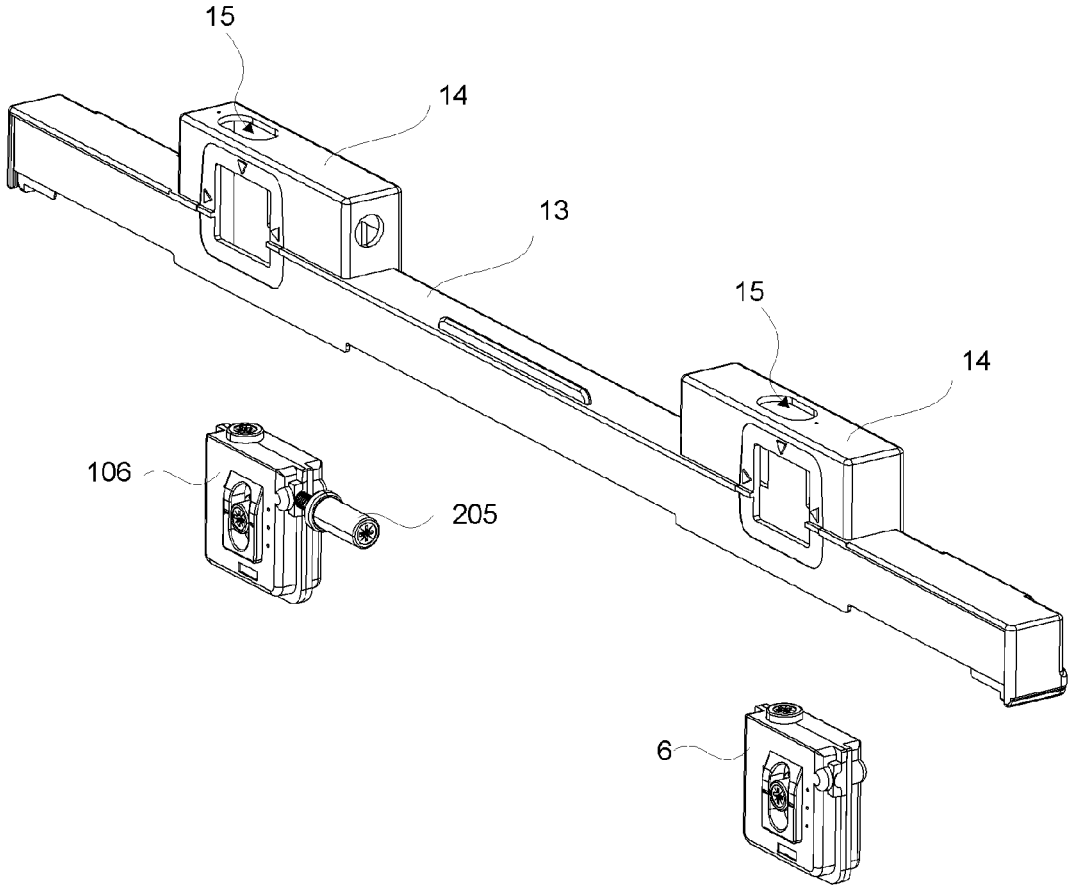

FIG. 6—is the exploded view of the housing and the adjustment mechanisms in an embodiment of the present invention.

The elements illustrated in the figures are numbered as follows:

1. Built-in household appliance
2. Body
3. Door
4. Decorative panel
5., 105., 205. Positioning screw
6., 106. Adjustment mechanism
7. Guide
8. Connector
9., 109., 209. Shaft
10. First transmitter
11. Second transmitter
12. Recess
13. Housing
14. Container
15. Stopper The built-in household appliance (1) comprises, a body (2) placed into the furniture, a door (3) providing access into the body (2), a decorative panel (4) mounted on the outer surface of the door (3), and at least two adjustment mechanisms (6)

fixed on the door (3)

providing the decorative panel (4) to be moved with respect to the door (3) by being rotated around its axis, having two positioning screws (5, 105) for two mutually perpendicular directions, the rotational axis of which extends in the direction wherein the decorative panel (4) is moved (FIG. 1).

In the built-in household appliance (1) of the present invention, one of the adjustment mechanisms (6, 106) comprises a third positioning screw (205), the rotational axis of which extends in the direction the decorative panel (4) is moved.

The decorative panel (4) is mounted on the outer surface of the door (3). After the mounting is performed, the maintenance personnel adjust the decorative panel (4) precisely in accordance with its position within the general appearance of the furniture by using the adjustment mechanisms (6, 106). The position of the decorative panel (4) in the two mutually perpendicular axes is adjusted by means of the positioning screws (5, 105). When the maintenance personnel desires to move the decorative panel (4) in the direction of one of the two mutually perpendicular axes, the positioning screw (5, 105) extending in that direction is rotated. Consequently, the maintenance personnel knows in which axial direction the decorative panel (4) is moved by any one of the two positioning screws (5, 105) and there is no waste of time during the mounting process.

The third positioning screw (205) provides the movement of the decorative panel (4) in the right and left directions. By means of the third positioning screw (205) being located on only one adjustment mechanism (6, 106), the problems that may occur due to rotational operations performed asynchronously are prevented. Thus, the decorative panel (4) is moved on the horizontal axis with only a single positioning screw (205) (FIG. 2, FIG. 3).

In an embodiment of the present invention, the built-in household appliance (1) comprises a first positioning screw (5) that provides the movement of the decorative panel (4) in a (z) axis extending in perpendicular direction with respect to the plane of the door (3), a second positioning screw (105) providing the movement thereof in a (y) axis extending in the vertical direction and a third positioning screw (205) providing the movement thereof in an (x) axis extending in the horizontal direction. The first positioning screw (5) provides forwards/backwards movement of the decorative panel (4), in the depth direction of the built-in household appliance (1). The second positioning screw (105) moves the decorative panel (4) in upwards/downwards directions and the third positioning screw (205) moves the decorative panel (4) in the right/left directions.

In an embodiment of the present invention, the built-in household appliance (1) comprises a housing (13) extending along the upper side of the door (3), having a container (14) wherein the adjustment mechanisms (6, 106) are disposed. Thus, the adjustment mechanisms (6, 106) are concealed and the adjustment mechanisms (6, 106) are provided to form an integrated appearance with the door (3).

In an embodiment of the present invention, the built-in household appliance (1) comprises a guide (7) disposed on the inner surface of the decorative panel (4) and a connector (8) disposed on the adjustment mechanisms (6, 106), pushing the adjustment mechanisms (6, 106) over the guide (7) thereby providing the decorative panel (4) to be slidingly mounted to the door (3). The guide (7) provides the door (3) to be easily fixed to the decorative panel (4). The adjustment mechanisms (6, 106) move the connector (8), the connector (8) moves the guide (7) and the guide (7) moves the decorative panel (4).

In a derivative of this embodiment, the connector (8) comprises a first shaft (9), formed as a screw thread, providing the first positioning screw (5) to be mounted thereon and which converts the rotational motion applied on the first positioning screw (5) into linear motion in the z axis. Thus, when the first positioning screw (5) is rotated, the decorative panel (4) moves forwards/backwards in the depth direction of the built-in household appliance (1). The movement freedom of the decorative panel (4) on the z axis is limited by the length of the first shaft (9) (FIG. 3, FIG. 4).

In an embodiment of the present invention, the built-in household appliance (1) comprises a first transmitter (10) that has a second shaft (109) in screw thread form, providing the second positioning screw (105) to be mounted thereon and that converts the rotational motion applied on the second positioning screw (105) into linear motion in the y axis. The first transmitter (10) moves in the vertical direction when the second positioning screw (105) is rotated on the second shaft (109) (FIG. 3, FIG. 4).

In an embodiment of the present invention, the built-in household appliance (1) comprises a second transmitter (11) that has a third shaft (209) in screw thread form, providing the third positioning screw (205) to be mounted thereon and that converts the rotational motion applied on the third positioning screw (205) into linear motion in the x axis. Thus, the second transmitter (11) moves either in the right or left directions depending on the rotational direction of the third positioning screw (205) on the third shaft (209) (FIG. 3, FIG. 4).

In a derivative of this embodiment, the second transmitter (11) comprises a recess (12) which allows the first transmitter (10) to move on the y axis and wherein the first positioning screw (5), actuated by the motion of the first transmitter (10), is disposed. The movement applied on the first transmitter (10) actuates only the first positioning screw (5), without acting on the second transmitter (11) and the unintentional movement of the decorative panel (4) in the x axis is prevented. Therefore, the recess (12) limits the movement of the second shaft (109) (FIG. 5).

In an embodiment of the present invention, the built-in household appliance (1) comprises the second transmitter (11) disposed in the container (14), the first transmitter (10) disposed into the second transmitter (11) and the first positioning screw (5) disposed in the first transmitter (10). Thus, the movement of the second transmitter (11) actuates the first transmitter (10) and the movement of the first transmitter (10) actuates the first positioning screw (5). The only contact between the adjustment mechanisms (6, 106) and the connector (8) is provided by means of the first positioning screw (5). Since the movement of the connector (8) depends on the movement of the first positioning screw (5), the movement of the decorative panel (4) in the three axes is realized as a result of movements transmitted to the first positioning screw (5) (FIG. 5, FIG. 6).

In a derivative of this embodiment, the built-in household appliance (1) comprises a stopper (15) situated on the container (14) and limiting the movement of the second transmitter (11) on the x axis. The hole-shaped stopper (15) moreover surrounds the second positioning screw (105) so as to be coplanar with the container (14). The movement of the third shaft (209) is limited by means of the stopper (15).

In different embodiments of the present invention, the built-in household appliance (1) is a dishwasher or a cooling device.

The rotational axis of the positioning screws (5, 105 and 205) situated in the built-in household appliance (1), are disposed on the same direction with each axis where the decorative panel (4) is moved. Consequently, the maintenance personnel quickly performs the mounting of the built-in household appliance (1) by preserving the esthetic appearance of the furniture.

It is to be understood that the present invention is not limited to the embodiments disclosed above and a person skilled in the art can easily introduce different embodiments. These should be considered within the scope of the protection postulated by the claims of the present invention.

The invention claimed is:

1. A built-in household appliance (1) comprising a body (2) placed into a furniture, a door (3) providing access into the body (2), a decorative panel (4) mounted on the outer surface of the door (3), and at least two adjustment mechanisms (6, 106)—fixed on the door (3),—providing the decorative panel (4) to be moved with respect to the door (3) by being rotated around its axis,—having two positioning screws (5, 105) for two mutually perpendicular directions, the rotational axis of each of the two positioning screws extends in one of the two mutually perpendicular directions the wherein the decorative panel (4) is moved, characterized in that—one of the adjustment mechanisms (6, 106) has a third positioning screw (205), of which the rotational axis extends in the direction the decorative panel (4) is moved.

2. A built-in household appliance (1) as in claim 1, characterized in that a first positioning screw (5) that provides the movement of the decorative panel (4) in a z axis extending in perpendicular direction with respect to the plane of the door (3), a second positioning screw (105) providing the movement thereof in a y axis extending in the vertical direction and a third positioning screw (205) providing the movement thereof in an x axis extending in the horizontal direction.

3. A built-in household appliance (1) as in claim 1, characterized in that a housing (13) extending along the upper side of the door (3), having a container (14) wherein the adjustment mechanisms (6, 106) are disposed.

4. A built-in household appliance (1) as in claim 3, characterized in that a second transmitter (11) disposed into the container (14), a first transmitter (10) disposed into the second transmitter (11) and the first positioning screw (5) disposed into the first transmitter (10).

5. A built-in household appliance (1) as in claim 4, characterized in that a stopper (15) situated on the container (14) and limiting the movement of the second transmitter (11) in the x axis.

6. A built-in household appliance (1) as in claim 1, characterized in that a guide (7) is disposed on the inner surface of the decorative panel (4) and a connector (8) disposed on the adjustment mechanisms (6, 106), that pushes the adjustment mechanisms (6, 106) over the guide (7) thereby providing decorative panel (4) to be mounted slidingly to the door (3).

7. A built-in household appliance (1) as in claim 6, characterized in that the connector (8) comprising a first shaft (9), formed as a screw thread, providing the first positioning screw (5) to be mounted thereon and which converts the rotational motion applied on the first positioning screw (5) into linear motion in the z axis.

8. A built-in household appliance (1) as claim 1, characterized in that a first transmitter (10) that has a second shaft (109) in screw thread form, providing the second positioning screw (105) to be mounted thereon and that converts the rotational motion applied on the second positioning screw (105) into linear motion in the y axis.

9. A built-in household appliance (1) as in claim 1, characterized in that a second transmitter (11) that has a third shaft (209) in screw thread form, providing the third positioning screw (205) to be mounted thereon and that converts the rotational motion applied on the third positioning screw (205) into linear motion in the x axis.

10. A built-in household appliance (1) as in claim 1, which is a cooling device.

11. A built-in household appliance (1) as in claim 1, which is a dishwasher.

12. A built-in household appliance (1) comprising a body (2) placed into a furniture, a door (3) providing access into the body (2), a decorative panel (4) mounted on the outer surface of the door (3), and at least two adjustment mechanisms (6, 106) fixed on the door (3), providing the decorative panel (4) to be moved with respect to the door (3) by being rotated around its axis, having two positioning screws (5, 105) for two mutually perpendicular directions, the rotational axis of which extends in the direction wherein the decorative panel (4) is moved, wherein one of the adjustment mechanisms (6, 106) has a third positioning screw (205), of which the rotational axis extends in the direction the decorative panel (4) is moved and further comprising a second transmitter (11) that has a third shaft (209) in screw thread form, providing the third positioning screw (205) to be mounted thereon and that converts the rotational motion applied on the third positioning screw (205) into linear motion in the x axis and wherein the second transmitter (11) comprising a recess (12) which allows the first transmitter (10) to move in the y axis and wherein the first positioning screw (5), actuated by the motion of the first transmitter (10), is disposed.

13. A built-in household appliance (1) as in claim 12, characterized in that a first positioning screw (5) that provides the movement of the decorative panel (4) in a z axis extending in perpendicular direction with respect to the plane of the door (3), a second positioning screw (105) providing the movement thereof in a y axis extending in the vertical direction and a third positioning screw (205) providing the movement thereof in an x axis extending in the horizontal direction.

14. A built-in household appliance (1) as in claim 12, characterized in that a housing (13) extending along the upper side of the door (3), having a container (14) wherein the adjustment mechanisms (6, 106) are disposed.

15. A built-in household appliance (1) as in claim 12, characterized in that a guide (7) is disposed on the inner surface of the decorative panel (4) and a connector (8) disposed on the adjustment mechanisms (6, 106), that pushes the adjustment mechanisms (6, 106) over the guide (7) thereby providing decorative panel (4) to be mounted slidingly to the door (3).

16. A built-in household appliance (1) as in claim 15, characterized in that the connector (8) comprising a first shaft (9), formed as a screw thread, providing the first positioning screw (5) to be mounted thereon and which converts the rotational motion applied on the first positioning screw (5) into linear motion in the z axis.

17. A built-in household appliance (1) as claim 12, characterized in that a first transmitter (10) that has a second shaft (109) in screw thread form, providing the second positioning screw (105) to be mounted thereon and that converts the rotational motion applied on the second positioning screw (105) into linear motion in the y axis.

18. A built-in household appliance (1) as in claim 12, characterized in that a second transmitter (11) disposed into the container (14), a first transmitter (10) disposed into the second transmitter (11) and the first positioning screw (5) disposed into the first transmitter (10).

19. A built-in household appliance (1) as in claim 18, characterized in that a stopper (15) situated on the container (14) and limiting the movement of the second transmitter (11) in the x axis.

20. A built-in household appliance (1) as in claim 12, which is selected from the group consisting of a cooling device and a dishwasher.

* * * * *